United States Patent [19]

Spence

[11] Patent Number: 4,721,234

[45] Date of Patent: Jan. 26, 1988

[54] CREASE SETTING APPARATUS

[75] Inventor: Derek W. Spence, Nr. Bingley, United Kingdom

[73] Assignee: Wool Development International Limited, West Yorkshire, United Kingdom

[21] Appl. No.: 916,563

[22] Filed: Oct. 7, 1986

[30] Foreign Application Priority Data

Oct. 8, 1985 [GB] United Kingdom ..... 8524802

[51] Int. Cl.[4] ..... B65D 88/54

[52] U.S. Cl. ..... 222/327; 118/410; 223/27

[58] Field of Search ..... 222/326, 327, 333, 563, 222/567, 566; 118/44, 410; 223/27; 401/48, 193

[56] References Cited

U.S. PATENT DOCUMENTS 3,997,084 12/1976 Davis, Jr. ..... 222/326

4,619,382 10/1986 Houlbrook et al. ..... 222/327

*Primary Examiner*—Joseph J. Rolla
*Assistant Examiner*—Kenneth Noland
*Attorney, Agent, or Firm*—Bert J. Lewen; Henry Sternberg

[57] ABSTRACT

An apparatus for the application of crease setting compositions comprises at least one moveable arm capable of insertion into the leg of a pair of trousers to be creased carrying at or near one end thereof an applicator head 10 comprising a cartridge 12 having a nozzle 22 for the application of crease setting composition. Guide means 20, in the form of a pivotted crease sensing blade, are provided for locating the nozzle 22 within the crease to be treated. The guide means 20 is moveable transversely of the direction of the motion of the trousers in order to locate in the trouser crease and the cartridge 12 is rotatable so that the nozzle 22 can follow in the track of said guide means.

7 Claims, 4 Drawing Figures

CREASE SETTING APPARATUS

This invention relates to a fluid dispensing applicator and in particular to an applicator for crease setting compositions.

In our European patent publication No. 0138327 there is disclosed an apparatus for the application of crease setting compositions which comprises at least one movable arm capable of insertion into a leg of a pair of trousers to be creased, the arm carrying at, or near, one end thereof an applicator head comprising a nozzle for the application of crease setting composition, and guide means for locating the nozzle within the crease to be treated, there being means for urging crease setting composition through the nozzle into the crease to be set in timed relationship with the relative movement between the applicator head and the trousers.

However one problem encountered with this apparatus is that in some cases the creases in a pair of trousers are not exactly opposite one another, i.e the distance between creases is not the same on one side of a trouser leg as it is on the other. Furthermore the creases may not be exactly straight going from top to bottom of a trouser leg. This can result in the apparatus wandering from the crease and consequently depositing a line of resin alongside the crease and thereby spoiling the appearance of the garment.

The invention seeks to provide an improved form of mechanism for use with the above mentioned apparatus which overcomes or reduces the above disadvantages.

According to the present invention there is provided an apparatus for the application of crease setting compositions which comprises at least one movable arm capable of insertion into a leg of a pair of trousers to be creased, the arm carrying at, or near, one end thereof an applicator head comprising a cartridge having a nozzle for the application of crease setting composition, and guide means for locating the nozzle within the crease to be treated characterised in that the guide means is movable transversely of the direction of motion of the trousers in order to locate the trouser crease and the cartridge is rotatable so that the nozzle can follow in the track of said guide means.

Conventional means, such as, for example, those described in our European Patent Publication No. 0138327, referred to above, are provided for actually applying the crease setting composition to the trouser crease.

Preferably the guide means is a pivoted crease sensing blade which is attached to the applicator and this blade has very low resistance to movement. It is therefore able to move easily and thus locate and follow the crease line. The crease sensing blade may be directly coupled to the nozzle or, preferably, may be connected thereto through a servo motor. Preferably a weight shield is also provided which takes most of the weight of the garment allowing the blade and the nozzle to move freely.

In one preferred embodiment the apparatus comprises a fluid applicator (more fully described in the above mentioned European patent application) having a rotatable cartridge and an applicator nozzle, hereinafter referred to as a nib, fixed thereto, a pivoted crease sensing blade which is connected to the applicator and located a predetermined distance from said nib, a weight bearing shield which carries the weight of the garment and associated electronc means which controls the motion of the cartridge responsive to the motion of the blade.

The invention will be described further, by way of example, with reference to the accompanying drawings in which:

FIG. 3 is a view from the other end of the applicator showing the weight shield and the nib protruding there through.

Figures 1, 2:
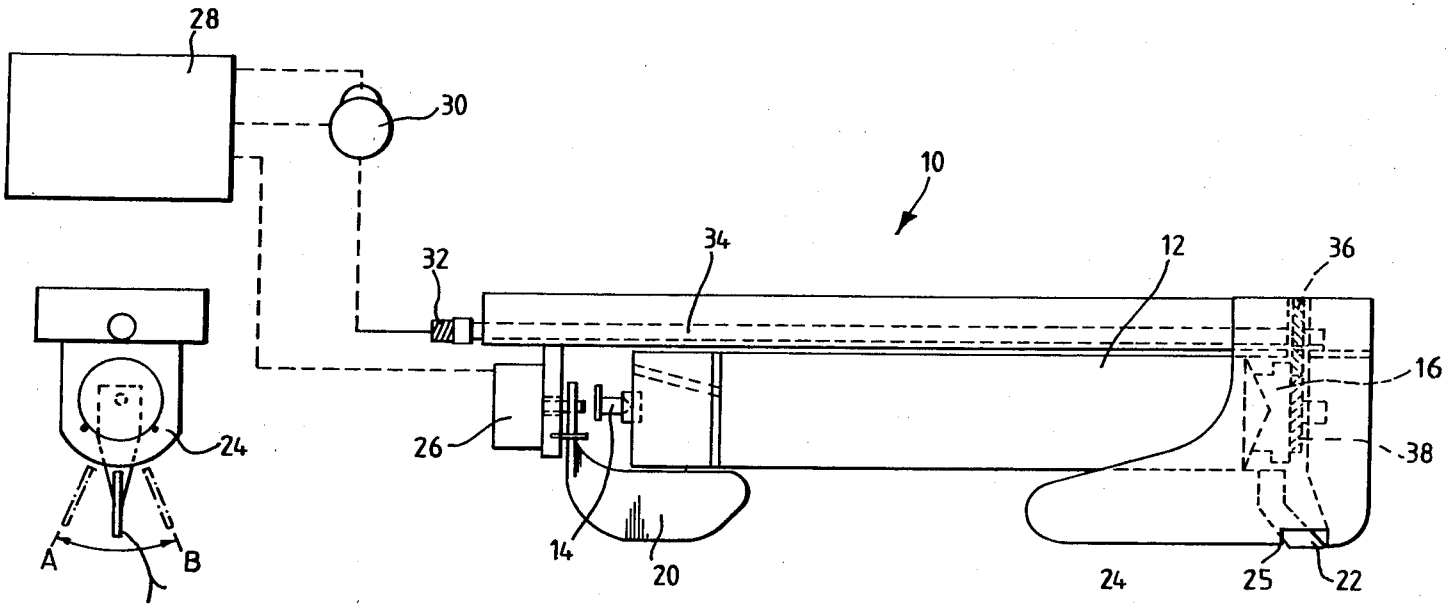
FIG. 1 is an illustration of the apparatus according to the invention.
FIG. 2 is an end view of the applicator showing the pivoted blade's range of motion.
Figure 4:
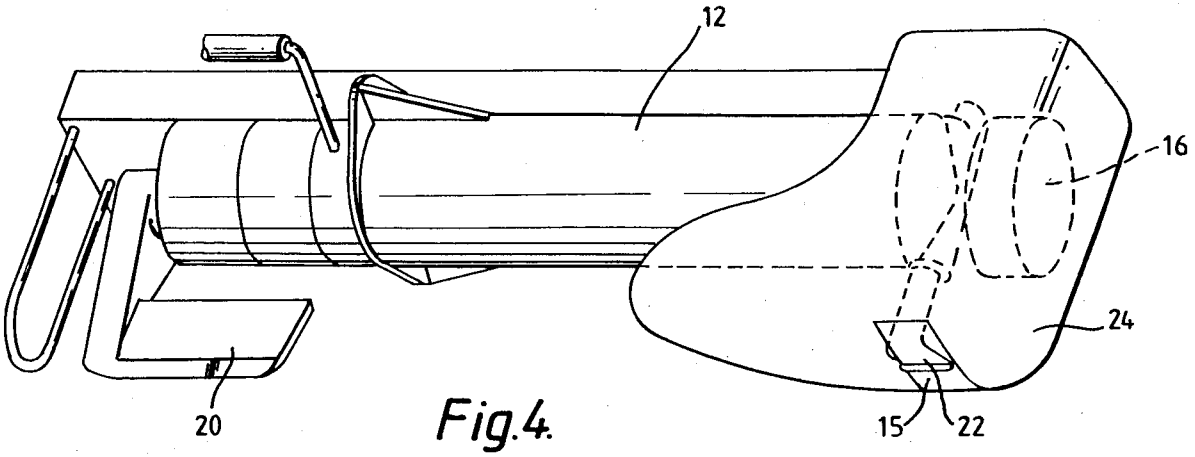
FIG. 4 is a perspective view of the apparatus.

Referring to the drawings, a fluid dispensing applicator 10 has a rotatable fluid cartridge 12 held in position by clips 14,16. These clips define the axis of rotation of the cartridge 12. A pivoted crease sensing blade 20 is attached to the apparatus which blade is substantially in line with a fluid dispensing nozzle or nib 22. A weight bearing shield 24, having an aperture 25 therein, covers the applicator to take the weight of the garment being treated. Electronic means in the form of a servo mechanism is provided. The servo mechanism includes a feedback box 26, e.g a potentiometer, which detects the motion of the blade 20 and sends information to a servo controller 28 and servo motor 30. The servo mechanism is linked to a flexible drive 32 which is connected to a drive rod 34. A gear wheel 36 connected substantially at one end of the drive rod intermeshes with a second gear wheel 38 which is fixed to the clip 16. This subsequently effects rotation of the cartridge 12 according to the sensed position of the blade 20.

In operation of the apparatus one applicator 10 is placed in side of a leg of a pair of trousers and the trousers are raised vertically. The weight bearing shield 24 carries the bulk of the weight of the fabric so as not to impart any substantial force on the nib 22. The nib 22 protrudes through the aperture 25 in the shield 24. In this embodiment the shield 24 only covers the nib 22, but the shield could readily be extended to also cover the blade 20. In this case the shield would have another aperture for the protrusion of the blade 20.

The blade 20, once placed in the crease then follows it as the trousers are raised. Information as to the blade's motion is relayed to the potentiometer 26, and a servo controller 28, in conjunction with a servo motor 30, dictates the cartridge rotation required for the nib 22 to follow the same track as the blade 20. The drive mechanism effects rotation of the cartridge by drive gears as described above. The drive rod 34 rotating in one direction, however, will consequently result in the cartridge 12 rotating in the opposite direction due to the gear effect. Provision is made for this in the servo mechanism, e.g by reversing the polarity of the signals. As the trousers are raised crease setting composition is deposited in the crease thereby permanently creasing the garment.

Figure 3:
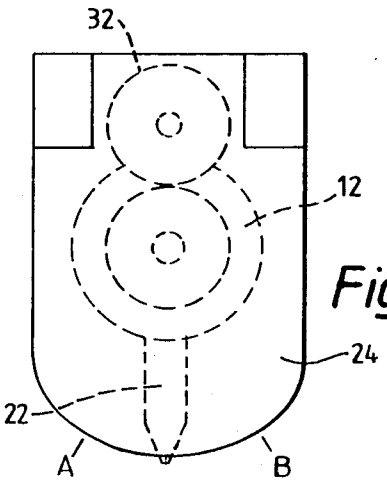

The weight shield 24 has a rounded surface and the aperture 25 therein allows the nib 22 to protrude slightly and to rotate within the limits shown in FIG. 3, i.e between A and B. It is desirable that the curvature of the shield 24 is the same as the curvature of the arc that the nib's motion describes so that the nib's protrusion is constant at all times. This is to reduce any effect of load on the nib itself. If the nib 22 is presented with excessive load, tracking by the nib will be affected. Since the cartridge 12 can now be rotated it can be seen that difficult unbalanced leg material can be handled as the applicator heads do not need to run exactly opposite each other.

The speed at which the trousers are raised depends on the weight of the fabric and for relatively fast trouser speeds, the nib 22 and blade 20 can be close together and therefore no time delay is required for the rotation of the cartridge 12. If the trouser speed is slow then the nib and blade are further apart and for the nib to follow the crease accurately, a time delay may be built into the servo mechanism.

The previous mechanism had rigid knife blades and a fixed cartridge and if these blades "ran off", as was often the case, then they formed their own crease thereby spoiling the appearance of the garment.

A distinct advantage of the present invention is that it allows trousers and other garments to be permanently creased much more effectively since the concept of a pivoting blade and rotating cartridge is much more versatile.

I claim:

1. An apparatus for the application of crease setting compositions which comprises at least one moveable arm which is inserted into a leg of a pair of trousers to be creased, the arm carrying near one end thereof an applicator head comprising a cartridge having a nozzle for the application for crease setting composition, and guide means spaced from the nozzle for locating the nozzle within the crease to be treated characterized in that the guide means is to be received in the crease of the trouser leg and moveable transversely of the direction of motion of the trousers in order to remain located in the trouser crease during movement of the latter, means rotatably mounting said cartridge and means operatively connecting said rotatable cartridge with said guide means for directing the nozzle to follow in the motion track of said guide means.

2. An apparatus as claimed in claim 1 in which the guide means is a pivotted crease sensing blade which is attached to the applicator.

3. An apparatus as claimed in claim 2 in which the blade has very low resistance to movement.

4. An apparatus as claimed in any of claims 1 to 3 in which the guide means is directly coupled to the nozzle.

5. An apparatus as claimed in any of claims 1 to 3 in which the guide means is connected to the nozzle through a servo motor.

6. An apparatus as claimed in any of claims 1 to 3 in which a weight shield is provided which takes most of the weight of the garment allowing the blade and the nozzle to move freely.

7. An apparatus as claimed in any of claims 1 to 3 further including electronic means cooperating with said cartridge and with said guide means for controlling the motion of the cartridge responsive to the motion of the guide means.

* * * * *